US005664550A

United States Patent [19]

Ito et al.

[11] Patent Number: 5,664,550

[45] Date of Patent: Sep. 9, 1997

[54] IGNITION SYSTEM OF INTERNAL COMBUSTION ENGINE

[75] Inventors: Takashi Ito, Hitachinaka; Katsuaki Fukatsu, Uridura-machi; Ryoichi Kobayashi, Tokai-mura; Noboru Sugiura, Mito, all of Japan

[73] Assignees: Hitachi, Ltd.; Hitachi Car Engineering Co., Ltd.

[21] Appl. No.: 691,329

[22] Filed: Aug. 2, 1996

[30] Foreign Application Priority Data

Aug. 4, 1995 [JP] Japan ..... 7-199449

[51] Int. Cl.[6] ..... F02P 11/00

[52] U.S. Cl. ..... 123/630

[58] Field of Search ..... 123/630, 644, 123/649, 650, 651, 652, 198 D, 198 DC, 426; 307/10.6

[56] References Cited

U.S. PATENT DOCUMENTS

| | | | |
|---|---|---|---|
| 4,996,964 | 3/1991 | Ohuchi | 123/479 |
| 5,156,127 | 10/1992 | Ghaem | 123/426 |
| 5,190,019 | 3/1993 | Harvey | 123/630 |
| 5,388,560 | 2/1995 | Hisaki et al. | 123/630 |
| 5,415,148 | 5/1995 | Kanehiro et al. | 123/630 |
| 5,490,489 | 2/1996 | Mayer et al. | 123/630 |
| 5,581,131 | 12/1996 | Urushiwara et al. | 307/10.6 |

*Primary Examiner*—Raymond A. Nelli

*Attorney, Agent, or Firm*—Evenson, McKeown, Edwards & Lenahan, P.L.L.C.

[57] ABSTRACT

An ignition circuit is formed in one chip comprising an insulated gate bipolar transistor for controlling the flow of a primary current, a current limiting circuit for limiting the current flowing into the transistor, and a thermal shut-off circuit capable of forcibly shutting off the primary current in case of trouble. In the ignition circuit, a power supply GND terminal and an ignition control signal positive terminal are divided.

8 Claims, 4 Drawing Sheets

IGNITION SYSTEM OF INTERNAL COMBUSTION ENGINE

BACKGROUND OF THE INVENTION

The present invention relates to an ignition system of an internal combustion engine and, more particularly, to an ignition system of an internal combustion engine which uses a one-chip integrated circuit.

A prior art ignition system, as disclosed in Japanese Patent Laid-Open No. Sho 64-45963 (1989), has a self-shut-off function to detect trouble from the duration of a primary current, thereby forcibly opening the circuit. The function is to count the set time by a timer and to shut off the primary current when a condition has exceeded a preset period of time.

The above-described prior art pertains to a method of detecting trouble from the duration of the primary current, and needs a timer circuit. The use of the timer circuit will make the ignition circuit complicated, which will need a large-capacity capacitor for setting the time constant, presenting such a problem that only one chip is not enough for forming the ignition system.

This method is ineffective and not necessarily reliable against rupture of power transistors caused by sudden heating by a load dump surge arising in case of battery line trouble. Furthermore, there arises such trouble that re-energizing will occur during the ON state of an ignition control signal.

Furthermore, there arises such trouble that since a negative terminal for the ignition control signal of the ignition circuit is used in common with a GND terminal, the electric potential at a positive terminal of the ignition control signal varies from the reference GND with a current variation in the power system, making it impossible to detect a disconnection or short circuit at the positive terminal of the ignition control signal.

SUMMARY OF THE INVENTION

It is, therefore, an object of the present invention to provide a self-diagnostic ignition system of an internal combustion engine.

It is another object of the present invention to provide an ignition system of an internal combustion engine which can prevent re-energizing during the ON state of an ignition control signal.

In an ignition system of an internal combustion engine provided with a primary coil and an ignition circuit which controls, according to an ignition control signal, the closing and opening of a primary current circuit in which a primary current flows to the primary coil, thereby establishing a high voltage on the secondary side thereof, the above-described object is accomplished by forming the ignition circuit in one chip integrating an insulated gate bipolar transistor (IGBT) for controlling the closing and opening of the primary current circuit, a current limiting circuit for limiting the current flowing into the transistor, and a thermal shut-off circuit for forcibly shutting off the primary current in case of trouble.

In an ignition system of an internal combustion engine provided with a primary coil and an ignition circuit which controls, according to an ignition control signal, the closing and opening of a primary current circuit in which a primary current flows to the primary coil, thereby establishing a high voltage on the secondary side thereof, another object stated above is also accomplished by forming the ignition circuit as a thermal shut-off circuit for forcibly shutting off the primary current in case of trouble, and a latching circuit for latching the output of the thermal shut-off circuit, in which the latching circuit is set when the ignition control signal is turned on and an overtemperature detecting signal has been detected, and is reset when the ignition control signal is turned off.

According to the present invention, in addition to the large-current switching function and the current limiting function of the prior art ignition system, it is possible to form in one chip the ignition system having a power transistor protection circuit for protection against uninterrupted current supply and a dump surge.

Also, by interlocking the thermal shut-off circuit with the latching circuit, it is possible to prevent accidental gate control voltage on-off operation of the IGBT during the ON time of the ignition signal, and to prevent the primary current chattering at the coil.

Furthermore, the provision of the ignition circuit with four external terminals makes it possible to reduce the effect of GND current variation at the time of primary current on-off operation of the coil by dividing GND into the ignition control signal negative terminal and power GND, and to reliably detect short circuit and open circuit at the ignition control signal positive terminal.

DETAILED DESCRIPTION OF THE EMBODIMENTS

Figure 1:
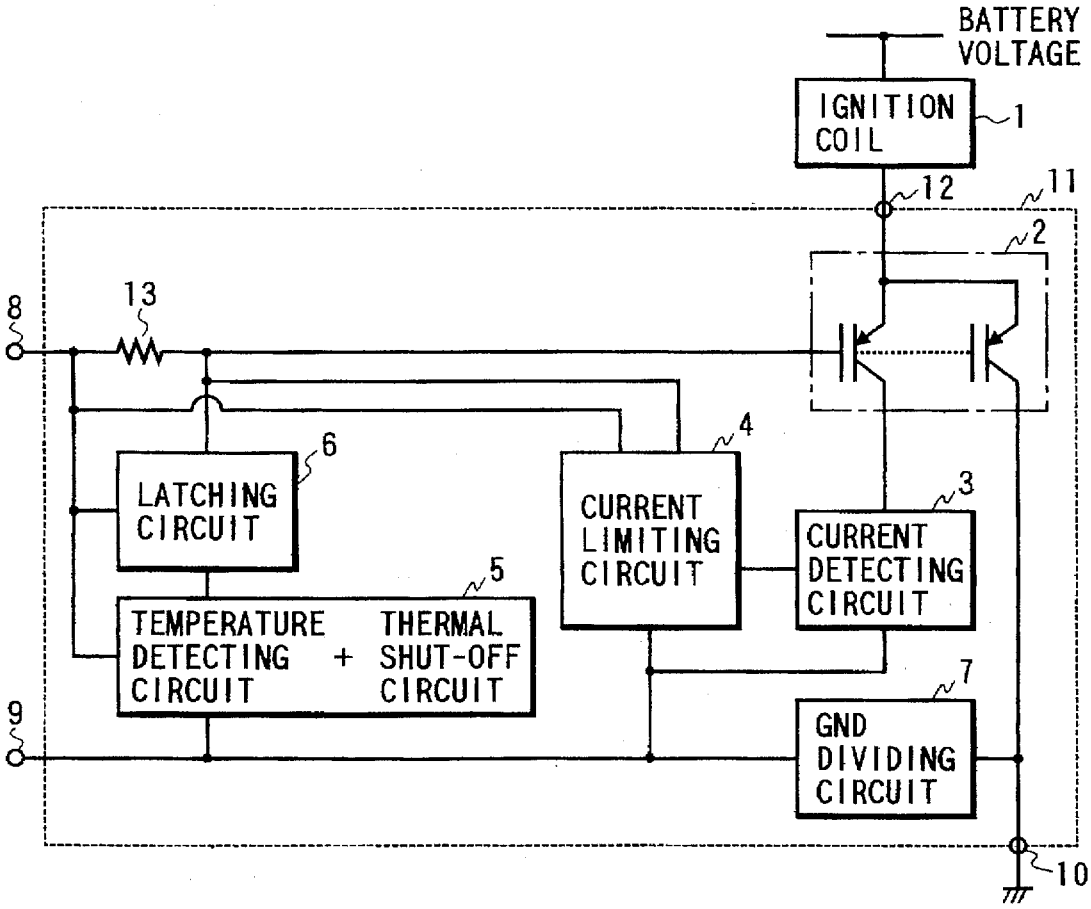
FIG. 1 is a block diagram of one embodiment of an ignition system of an internal combustion engine according to the present invention.

Preferred embodiments of the present invention will be explained with reference to the accompanying drawings. FIG. 1 shows one embodiment of the constitution of an ignition system of an internal combustion engine according to the present invention. The ignition system consists of an ignition coil 1 and an ignition circuit 11. The ignition circuit 11 has an IGBT 2 for closing and opening the primary current circuit to supply a primary current to a primary coil of the ignition coil 1, a current detecting circuit 3 for detecting the primary current, a current limiting circuit 4 for limiting the primary current to a preset value by controlling the gate voltage by the current detecting circuit 3, a thermal shut-off circuit 5 having a temperature detecting function for detecting chip temperature, for forcibly shutting-off and resetting the primary current depending upon conditions, a latching circuit 6 for latching the output of the thermal shut-off circuit 5, a power supply GND 10, an ignition control signal negative terminal 9, and a GND dividing circuit 7 for dividing the power source GND 10. The ignition circuit 11 is a one-chip IC integrally comprising the IGBT 2, the current limiting circuit 4 and the thermal shut-off circuit 5, and includes four external terminals, that is, an ignition control signal positive terminal 8, the ignition control signal negative terminal 9, the power supply GND 10, and a primary coil output terminal 12. A resistor 13 is provided to ensure the operating power source of the above-described circuit when the gate voltage of the IGBT 2 is introduced through the thermal shut-off circuit 5, the current limiting circuit 4 and the latching circuit 6.

Operation of the latching circuit 6 will be explained with reference to FIGS. 2 and 3.

Figure 2:
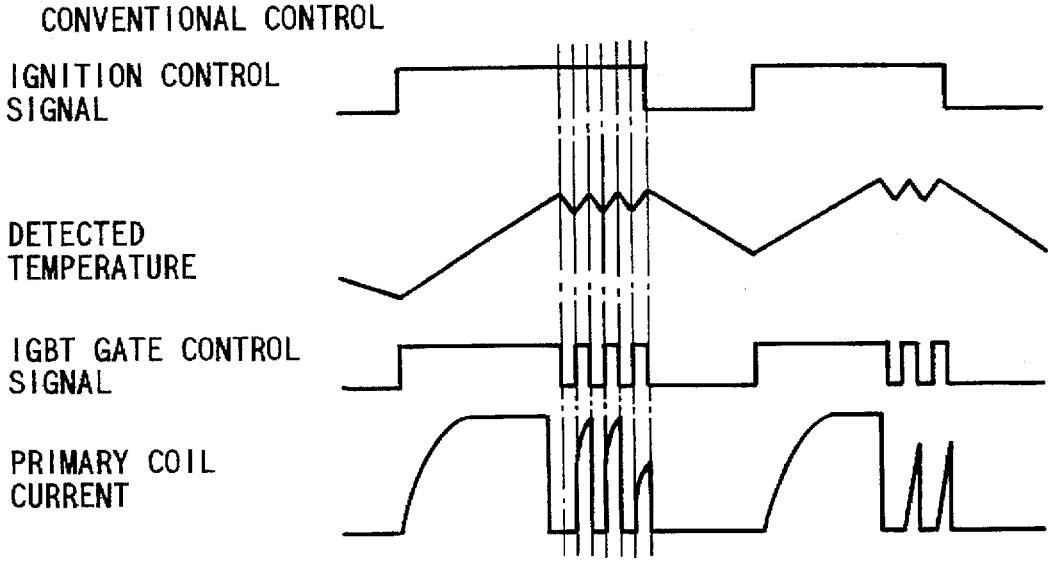
FIG. 2 is a signal waveform diagram showing the operation of a conventional ignition system.

FIG. 2 shows a time chart of general thermal shut-off operation controlled by time or hysteresis.

When the ignition signal is ON (Hi), the primary coil current is supplied. With the detection of an initially set permissible element temperature achieved by heating when the current is supplied, the IGBT gate control signal will be switched to OFF (Low), and then to ON (Hi) again by time or hysteresis, thus again supplying the primary coil current. Repeating these operations produces a secondary voltage of the ignition coil for a plurality of times notwithstanding the ignition control signal remaining unchanged in the ON (Hi) state.

Figure 3:
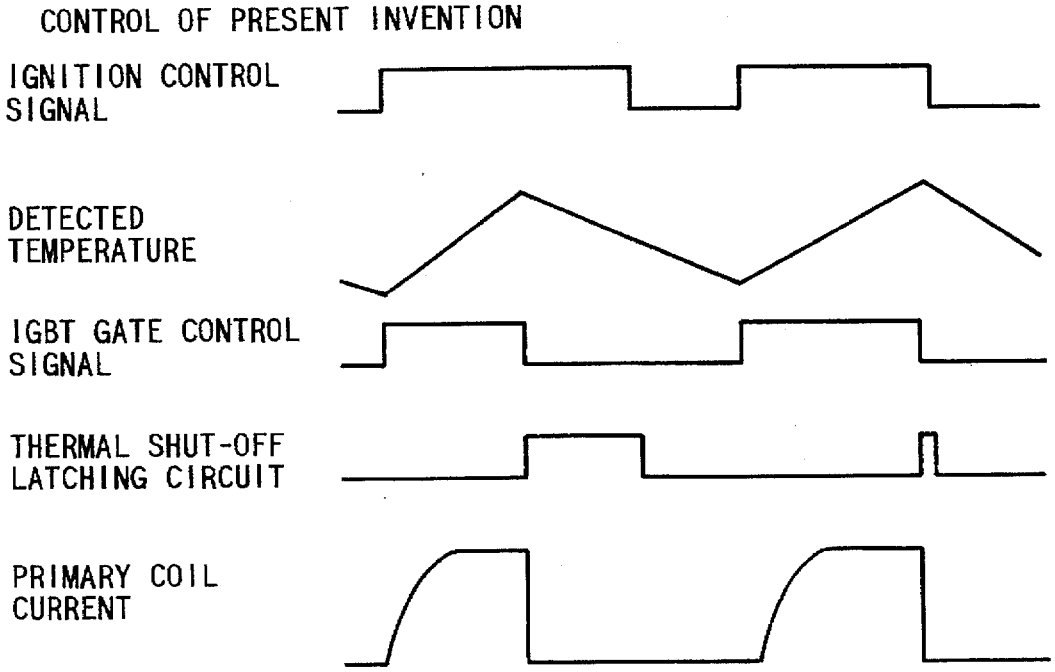
FIG. 3 is a signal waveform diagram showing the operation of the ignition system according to the present invention.

FIG. 3 shows an example of operation of the present invention. Under a condition similar to the above-described, when the detected temperature reaches the initial preset value, the thermal shut-off latching circuit is set to hold the ignition control signal until switching from ON to OFF, and is then reset by the switching of the signal from ON to OFF. This operation prevents repetitive primary current ON–OFF operation when the ignition control signal is in the ON state which occurs in conventional examples, thereby preventing accidental occurrence of the secondary voltage of the coil.

Insertion of the GND dividing circuit 7 divides the negative terminal 9 of the ignition control signal from the power GND 10 to thereby stabilize the electric potential at the ignition control signal positive terminal 8 in relation to the ignition control signal negative terminal 9 thus, ensuring reliable detection of a short circuit and open circuit at the ignition control signal positive terminal.

Provided that the GND is not divided, the primary current at the ignition coil 1 will vary within the range of from 0 to 10 A, and even if the wiring resistance at the GND is set 0.05 Ω, the primary current also varies by 0.5 V, therefore if a reference is set at the GND 10, the electric potential at the ignition control signal positive terminal 8 will be affected by the variation of the GND potential, making it impossible to distinguish an open circuit or short circuit at the ignition control signal positive terminal.

Figure 4:
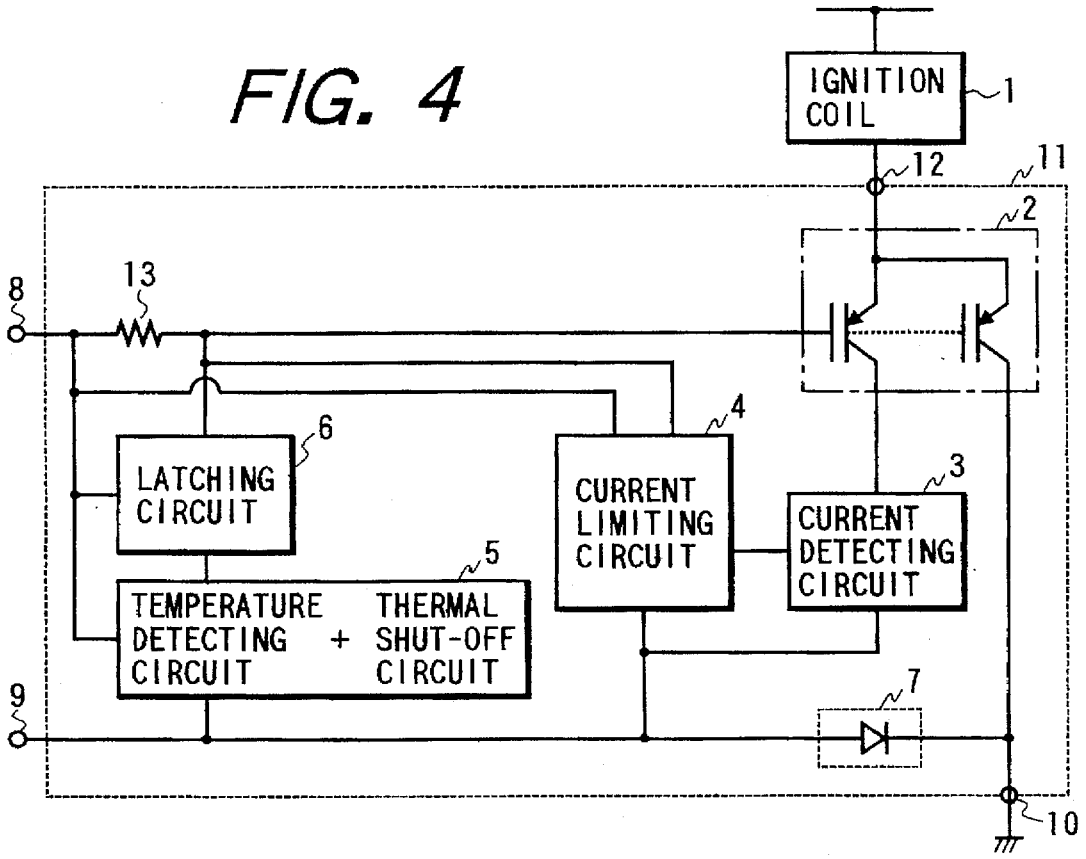
FIG. 4 is a block diagram of another embodiment of the ignition system of an internal combustion engine according to the present invention.
Figure 5:
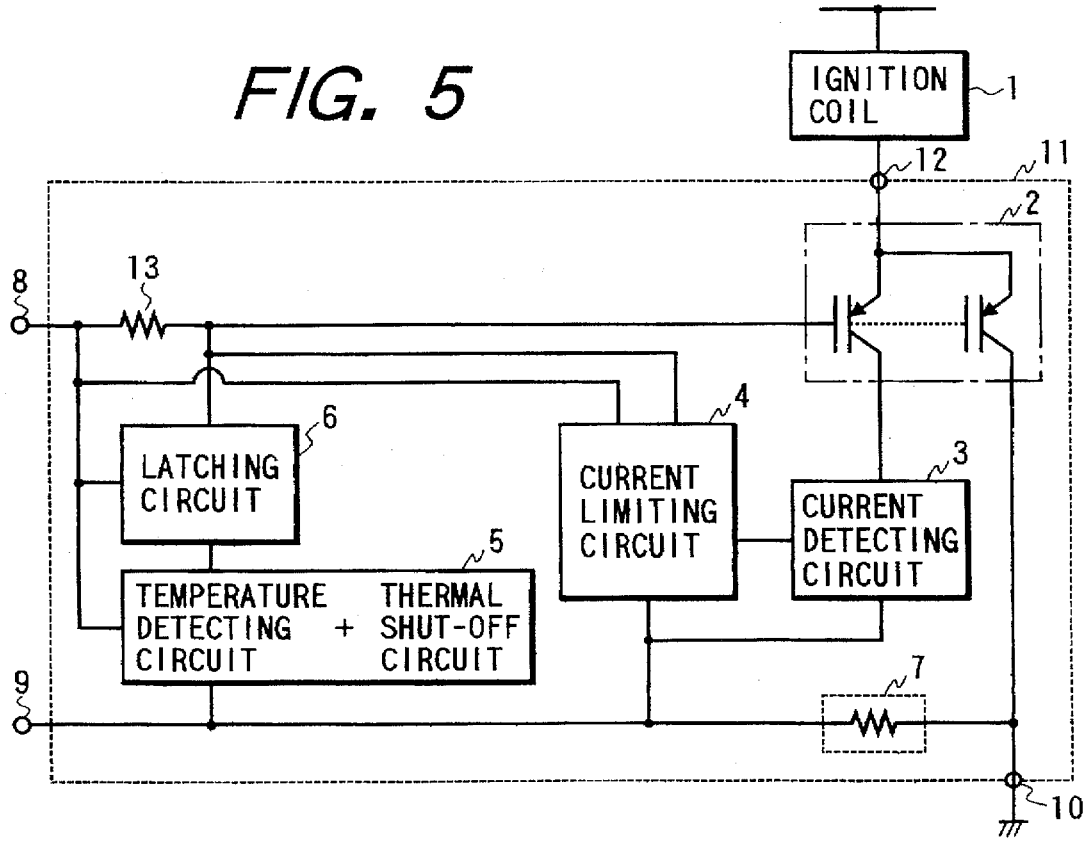
FIG. 5 is a block diagram of another embodiment of the ignition system of an internal combustion engine according to the present invention.

FIGS. 4 and 5 show examples of the GND dividing circuit. In FIG. 4, the GND dividing circuit is composed of a diode, and is connected in a forward direction with the power supply GND from the ignition control signal GND, thereby eliminating the effect of a tremendous current flowing into the power supply GND upon the signal GND. FIG. 5 shows the GND dividing circuit composed of a resistor. The resistor is inserted between the ignition signal GND and the power supply GND, thereby decreasing the effect of a tremendous current flowing into the power GND upon the signal GND.

Figure 6:
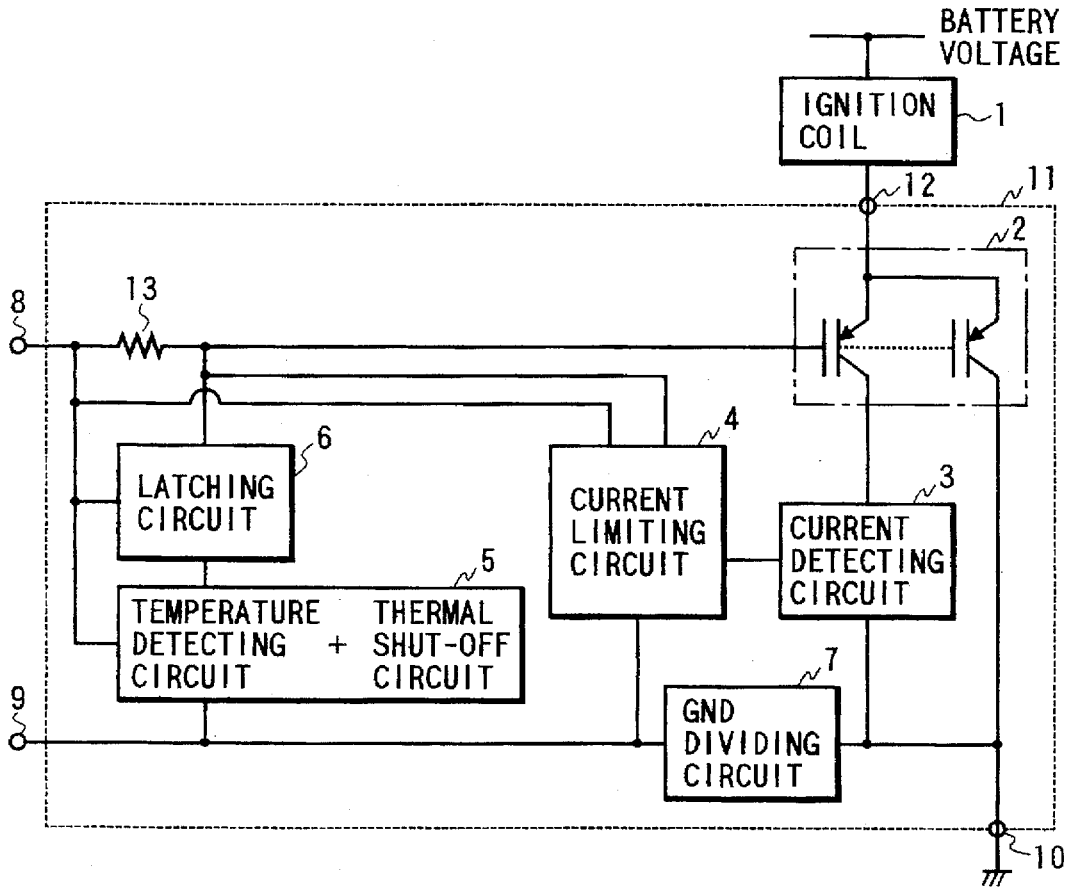
FIG. 6 is a block diagram of another embodiment of the ignition system of an internal combustion engine according to the present invention.

FIG. 6 shows another example of the ignition system of the internal combustion engine of FIG. 1. The circuit constitution is basically the same as that of FIG. 1. In the ignition system of FIG. 1, the GND dividing circuit 7 is arranged between the current detecting circuit 3 and the power supply GND 10, while in the ignition system of FIG. 6 the GND dividing circuit 7 is provided between the current detecting circuit 3 and the ignition control signal negative terminal 9. According to this constitution, when the primary current detecting current flowing into the current detecting circuit 3 is as large as several 10 mA, it is possible particularly to prevent the flow of the current into the ignition control signal negative terminal 9 and, at the same time, to nullify the effect of the primary current detecting current, thereby facilitating setting the operation range of the current control circuit. The GND dividing circuits shown in FIGS. 4 and 5 are also used in the ignition system of FIG. 6.

According to the present invention, it becomes possible to prevent trouble by latching the output of the thermal shut-off circuit. Also, it is possible to prevent re-energizing while the ignition control signal is ON by setting the latching circuit when the ignition control signal is switched ON and by resetting the latching circuit when the ignition control signal is switched OFF.

What is claimed is:

1. An ignition system of an internal combustion engine provided with a primary coil and an ignition circuit which controls the flow of a primary current according to an ignition control signal to produce a high voltage on the secondary side, said ignition circuit comprising one integrated chip having an insulated gate bipolar transistor for controlling the flow of the primary current, a current limiting circuit for limiting the current flowing to said transistor, and a thermal shut-off circuit for forcibly opening the primary current circuit in case of a malfunction.

2. An ignition system of an internal combustion engine as claimed in claim 1, wherein said ignition circuit has four external terminals.

3. An ignition system of an internal combustion engine as claimed in claim 2, wherein said external terminals are an output terminal for outputting the primary current to said primary coil, a positive terminal and a negative terminal for said ignition control signal, and a power source GND terminal.

4. An ignition system of an internal combustion engine as claimed in claim 3, wherein a resistor is provided for dividing the current to said GND terminal and to said negative terminal.

5. An ignition system of an internal combustion engine as claimed in claim 1, wherein a latching circuit is provided for latching the output of said thermal shut-off circuit.

6. An ignition system of an internal combustion engine as claimed in claim 5, wherein said latching circuit is set when said ignition control signal is turned on and an overtemperature detecting signal has been detected, and is reset when said ignition control signal is turned off.

7. An ignition system of an internal combustion engine provided with a primary coil and an ignition circuit which controls the flow of a primary current according to an ignition control signal to produce a high voltage on the secondary side, said ignition circuit comprising a thermal shut-off circuit for forcibly opening the primary current circuit in case of a malfunction, and a latching circuit for latching the output of said thermal shut-off circuit; said latching circuit being set when said ignition control signal is turned on and an overtemperature detecting signal has been detected, and is reset when said ignition control signal is turned off.

8. An ignition system of an internal combustion engine provided with a primary coil and an ignition circuit coupled thereto, wherein said ignition circuit comprises a single chip integrally including an insulated gate bipolar transistor having an output which couples with the primary coil;

a current limiting circuit coupled to said insulated gate bipolar transistor; and a thermal shut-off circuit coupled to the insulated gate bipolar transistor.

* * * * *